US009003570B2

(12) United States Patent
Kay et al.

(10) Patent No.: US 9,003,570 B2
(45) **Date of Patent: *Apr. 14, 2015**

(54) CAP WITH A BILL HAVING UPPER AND LOWER PORTIONS DISPLAYING INFORMATION WHEN SPACED-APART

(71) Applicant: Cisco Sales Corporation, Torrance, CA (US)

(72) Inventors: Jordan S. Kay, Rancho Palos Verdes, CA (US); Neil J. Kay, Rancho Palos Verdes, CA (US)

(73) Assignee: Cisco Sales Corp. (USA), Torrance, CA (US)

( * ) Notice: Subject to any disclaimer, the term of this patent is extended or adjusted under 35 U.S.C. 154(b) by 3 days.

This patent is subject to a terminal disclaimer.

(21) Appl. No.: 13/894,584

(22) Filed: May 15, 2013

(65) Prior Publication Data

US 2014/0338097 A1 Nov. 20, 2014

(51) Int. Cl.

| | |
|---|---|
| ***A42B 1/00*** | (2006.01) |
| ***A42B 1/06*** | (2006.01) |
| ***A42B 1/24*** | (2006.01) |

(52) U.S. Cl.

CPC ..... *A42B 1/064* (2013.01); *A42B 1/248* (2013.01)

(58) Field of Classification Search

CPC ..... A42B 1/062; A42B 1/004; A42B 1/24; A42B 1/248

USPC ..... 2/195.1, 195.5, 195.6, 195.7

See application file for complete search history.

(56) References Cited

U.S. PATENT DOCUMENTS

| | | | | | |
|---|---|---|---|---|---|
| 911,126 | A * | 2/1909 | Harrison | 2/171.6 |
| 1,716,719 | A * | 6/1929 | Christopher | 2/10 |
| D284,328 | S * | 6/1986 | Bieber | D2/872 |
| 4,777,667 | A * | 10/1988 | Patterson et al. | 2/195.5 |
| 4,985,935 | A * | 1/1991 | Hur | 446/27 |
| 5,343,568 | A * | 9/1994 | May | 2/195.1 |
| 5,553,325 | A * | 9/1996 | Gutierrez | 2/171 |
| 5,689,830 | A * | 11/1997 | Pflum | 2/195.1 |
| D414,315 | S * | 9/1999 | Kim | D2/869 |
| D416,376 | S * | 11/1999 | Schmalschlager et al. | D2/869 |
| 6,088,837 | A * | 7/2000 | Baker | 2/195.1 |
| 6,473,907 | B1 * | 11/2002 | Harwood | 2/209.13 |
| 6,959,454 | B2 * | 11/2005 | DeWinter | 2/195.1 |
| 7,082,618 | B1 * | 8/2006 | Muso | 2/175.1 |
| D529,262 | S * | 10/2006 | Yan | D2/876 |
| D612,134 | S * | 3/2010 | Hoffman | D2/872 |
| 2006/0242751 | A1 * | 11/2006 | Koo | 2/171 |
| 2011/0061145 | A1 * | 3/2011 | Zuloff | 2/209.13 |

* cited by examiner

*Primary Examiner* — Khoa Huynh
*Assistant Examiner* — Anna Kinsaul
(74) *Attorney, Agent, or Firm* — Irving Keschner

(57) ABSTRACT

A flip cap which has crown and bill portions, the bill having upper and lower members, at least one of the upper and lower portions having a surface capable of displaying information secured thereto when the upper and lower members are spaced-apart.

1 Claim, 6 Drawing Sheets

CAP WITH A BILL HAVING UPPER AND LOWER PORTIONS DISPLAYING INFORMATION WHEN SPACED-APART

BACKGROUND OF THE INVENTION

1. Field of the Invention

The present invention provides a cap, or visor, having a bill, the bill having a fixed lower portion and a movable upper portion, both bill portions having the capability of visually displaying information to a person near the wearer.

2. Description of the Prior Art

Various types of caps having a bill that can move from a first to second position for entertainment and advertising purposes have been available in the prior art.

For example, U.S. Pat. No. 4,777,667 to Patterson et al discloses a flip bill cap wherein the bill portion is adapted to be raised to disclose an entertaining and advertising message thereon. The bill portion is activated by the cap wearer using either a string or a solenoid. Indicia is formed directly on the underside of the bill portion in one embodiment and in a second embodiment, the bill portion has a track, or slot, formed therein. A card having indicia formed thereon is slideable within the track to be viewed through a window when the bill portion is moved to the angularly upright position.

The mechanism disclosed for moving the bill to its angular position is awkward and expensive and thus what is desired is to provide a cap flip bill for displaying messages which a simpler and less expensive than caps currently available including the cap disclosed in the '667 patent.

SUMMARY OF THE INVENTION

The present invention provides a flip cap (or visor) that has a bill comprised of upper and lower portions, the upper bill portion being secured to the bottom bill portion when the cap is in the normal wearer mode. When the wearer decides to display a message, the bill portions are separated, the upper bill portion extending in an angularly upright direction. Information is formed on signboards secured to both bill portions and then displayed in a manner to be viewable by persons near the wearer.

The present invention thus provides a flip bill cap that comprises upper and lower bill portions and wherein in one mode the bill portions are joined together and in a second mode are spaced-apart to display information on signboards secured to the upper and lower bill portions. The cap is simple to fabricate at an economical cost.

DESCRIPTION OF THE DRAWINGS

For a better understanding of the present invention as well as other objects and further features thereof reference is made to the following description which is to be read in conjunction with the accompanying drawing therein.

DESCRIPTION OF THE INVENTION

Figure 1:
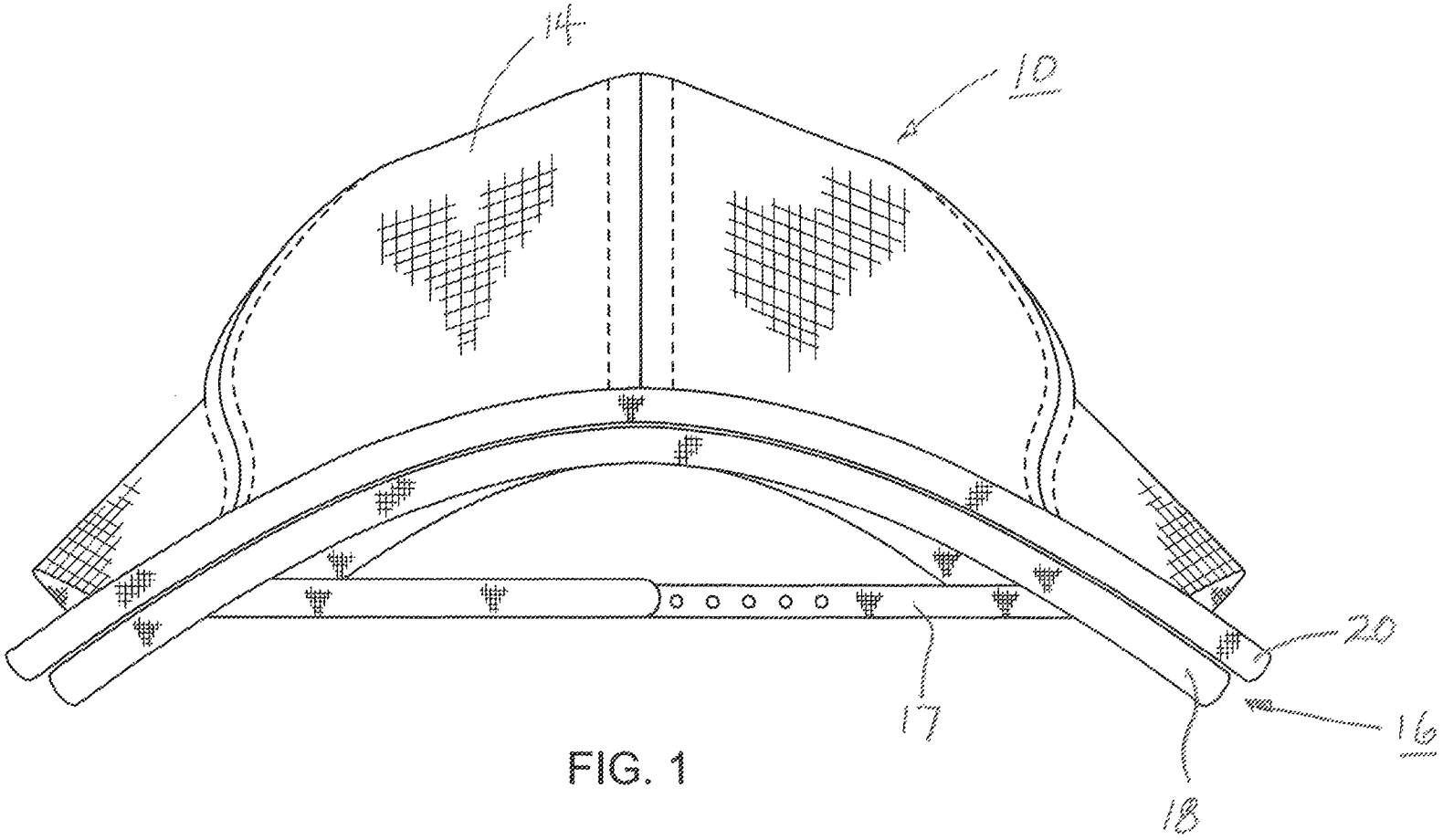
FIG. 1 is a front view of a cap in accordance with the teachings of the invention with upper and lower bill portions positioned together.
Figure 2:
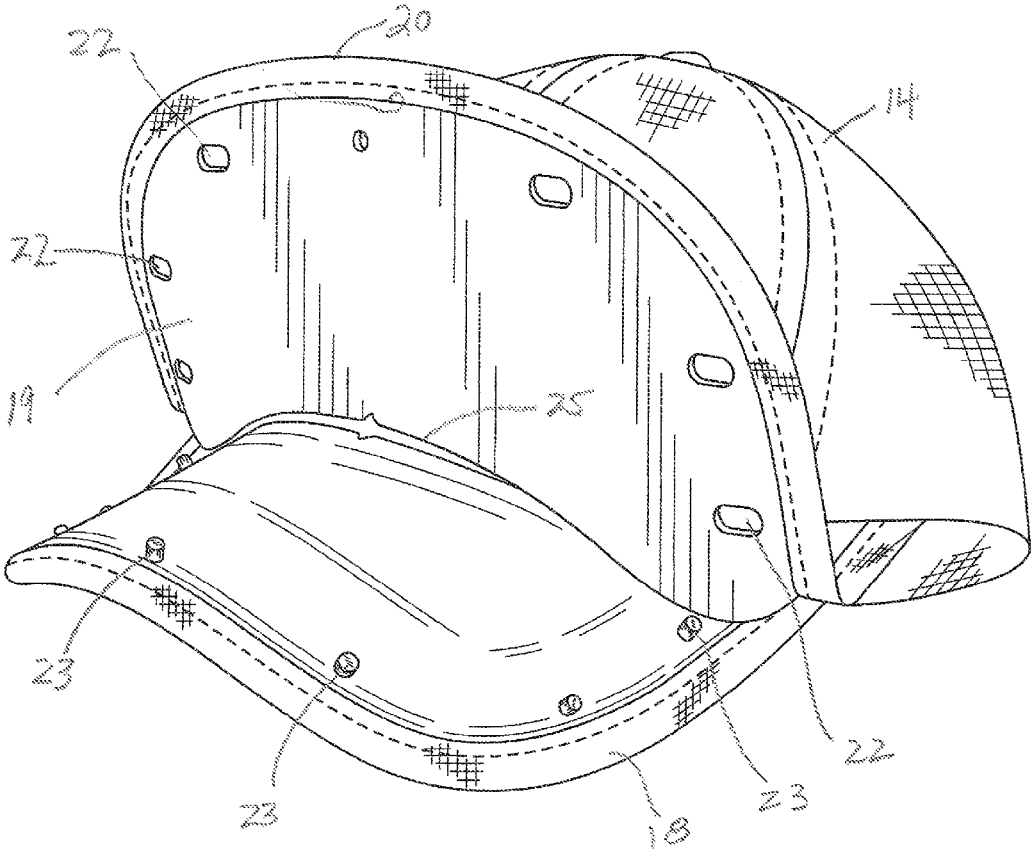
FIG. 2 is a side perspective view illustrating the cap of FIG. 1 with the upper and lower bill portions spaced-apart.
Figure 3:
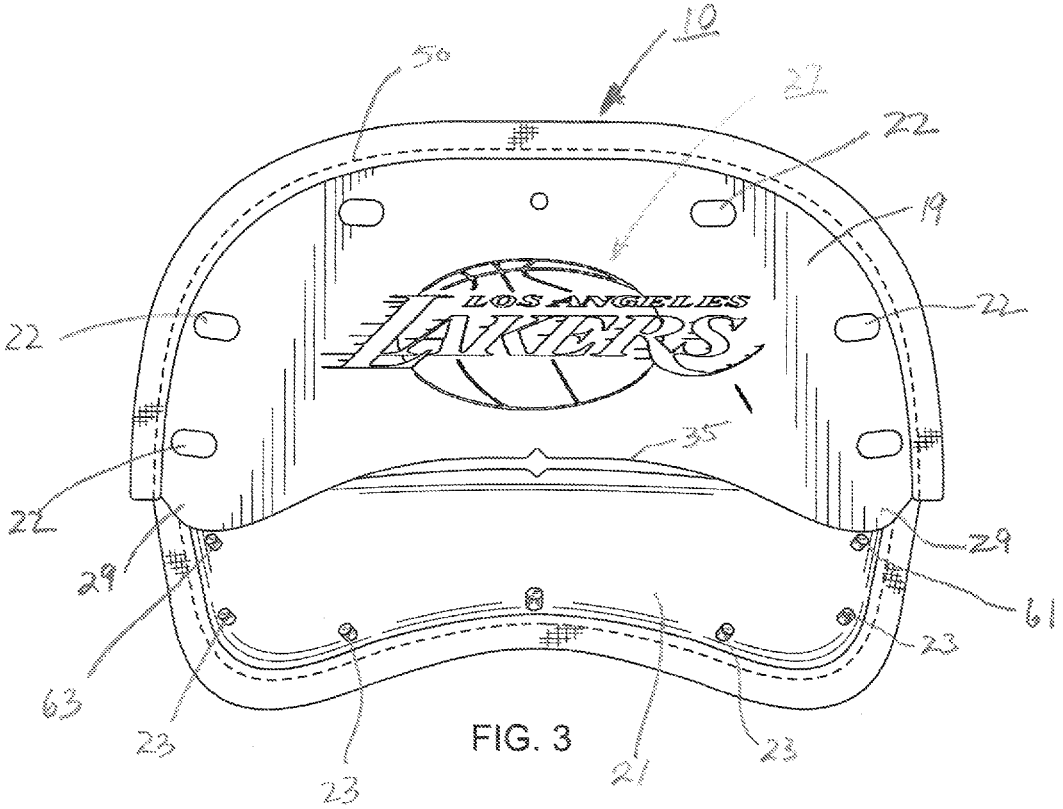
FIG. 3 is a front elevational view of the separated bill portions.
Figure 4:
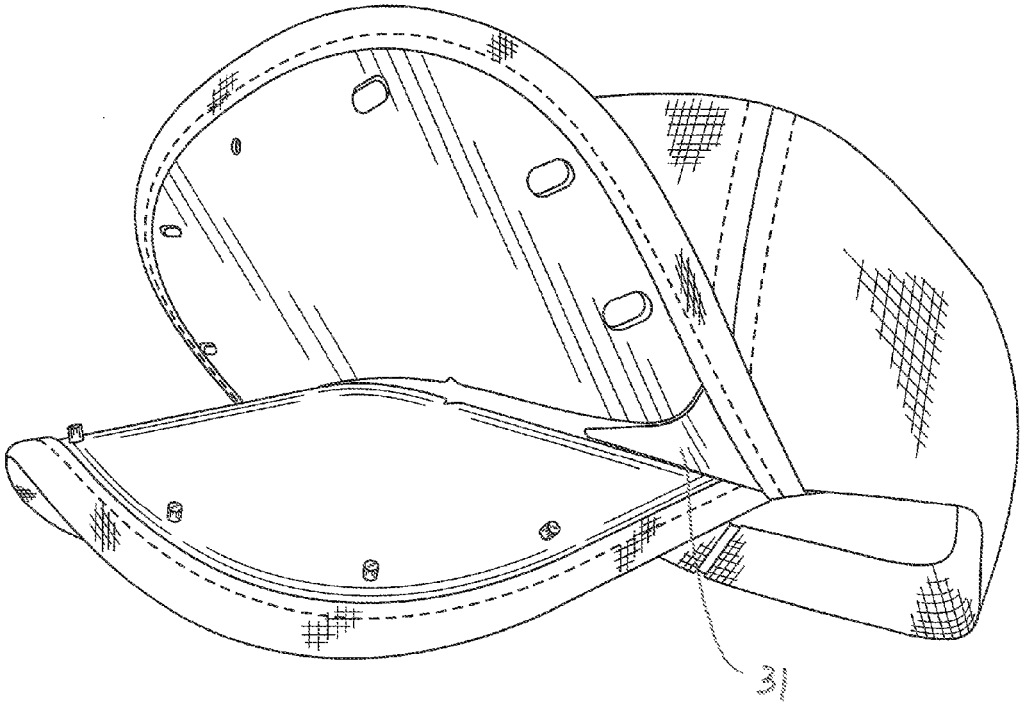
FIG. 4 is a side perspective view of the cap of FIG. 1 with the upper and lower bill portions spaced-apart.
Figure 5:
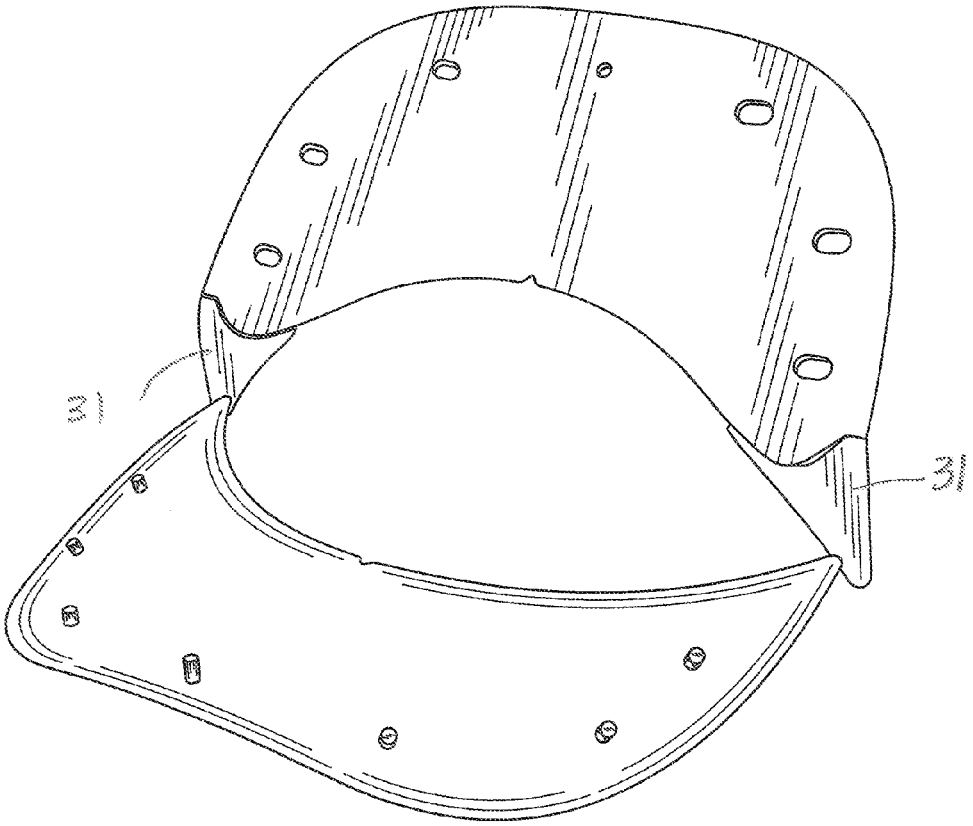
FIG. 5 is a side perspective view of two components that form the locking mechanism of the present invention.
Figure 6:
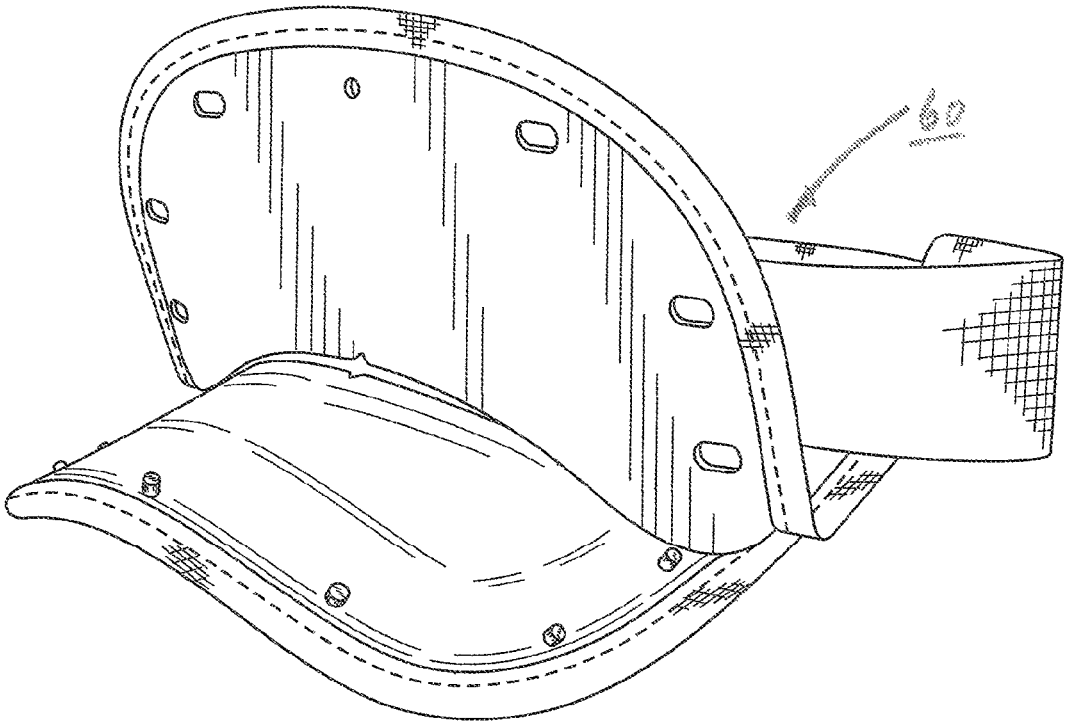
FIG. 6 is a side perspective View of a visor that utilizes the teachings of the present invention.

FIG. 1 is a front view of a flip cap 10 incorporating the teachings of the present invention (note that the present invention can be used as a flip visor as illustrated in FIG. 6). Cap 10 includes a crown portion 14 to be worn on the head of a wearer and a headband 17. Bill portion 16 comprises lower member 18 and upper member 20, upper member 20 being pivotally connected to lower member 18. Upper member 20 is removably secured to lower member 18, a plurality of oval shaped openings, or holes, 22 (FIG. 2), formed thereon engaging upright pins 23 secured to lower member 18 when the upper and lower members are pushed together by the wearer. When it is desired to display a message placed on the surface of a plastic board 19 sewn to upper member 20 as shown in FIG. 3, upper member 20 is separated from lower member 18 by the wearer and moved upwardly to a position at a substantially right angle to lower member 18. The lower edge portion 25 of member 20 is designed to lock the member in the display position until a user decides to no longer display the message as described hereinafter.

The bill members 18 and 20, when snapped together, makes cap 10 look like a conventional bill cap prior to being flipped, or moved, by the user; the act of flipping causes the pins 23 formed on member 18 to be released from holes 22, upper member 20 manually rising up until it is in its fixed/locked position.

The message 27, in a preferred embodiment, is created by a software program available to a user so that a personalized message can be created on a computer. The message, once created, is then printed directly onto the surface of signboard 19, the board then being cut to a size whereby it covers the inside surface of upper member 20 during the cap assembly process.

The upper bill member board 19 is a single piece, with a curved cut 29 formed at both corners thereof to create a locking hinge, the two end portions of board 19 being cut in a rounded pattern to the edge of sew lines formed therein. This enables bill member 20 to flip and stay standing on its own without resting on the front of cap when worn. The hinge function allows the upper bill member 20 to move up and then back down to snap closed. In particular, the furthest back end of upper member 19 has a pair of essentially triangular shaped pieces 31 cut therein. The cut functions as an anchor point allowing bill member 20 to be flipped up while remaining joined to the lower bill member 18. The curved cut allows upper bill member 20 to be flipped while the end triangular pieces thereof remain housed and connected to the bottom bill member 18. The two triangular pieces 31 are stitched through to the bottom bill member 18 while the curved cut of the upper bill member 20 is movable substantially 90 degrees to the bottom bill member 18 since it is not stitched thereto. The curved cut out design enables the triangular portion of the top bill member 20 to be stitched to the bottom bill member 18 while allowing the curved cut out 29 "to slide" forward and rest on the bottom of bill member 18 while holding signboard 19 securely in place, creating a 90 degree viewing angle for the signboard. The signboard portion 19 is movable up to a 90 degree angle while the triangular end pieces are non-movable and remain stationary. When flipped back down, the curved edge 35 seamlessly retracts allowing the cap 10 to appear as a regular cap.

When both upper and lower members 18 and 20 are snapped closed and locked into place (now resembling a standard cap), the holes, or openings 22, on the top bill member 20 allows the coaligned male pins 23 on the lower bill member 18 to move side to side (right to left). This allows the wearer to bend or manipulate the closed, cap bill while the integrity of the pins remain unchanged and the bill members to be securely snapped together.

When upper bill member 20 is snapped closed, the upper and lower bill members are locked together as the pins fit into the coaligned holes; when the upper bill member 20 is opened by a user, the pins unsnap from the holes manually, the top bill member's lower curved cut portion then sliding forward as noted hereinabove into position resting on top of sign board 21 secured to lower bill member 18. The upper bill member 20 is thus locked into place as a result of the cut 25 formed in top bill member 20. Pins 61 and 63 then act as stoppers ensuring bill member 20 does not exceed a 90 degree angle with respect to the lower bill member 18 when flipped open.

The reinforced sewing closure located on the back edge of each bill member ensures that the cap flips up and keeps both the lower and upper bill members together so both bills are attached as with a conventional cap. The reinforced sewing keeps the top bill member 20 in place and connected to lower bill member 18 so it can be both opened and closed at ease. It holds together when flipped as well as keeping the snap closures in alignment when moved back to the log ked down position.

There are two essentially parallel sew lines (only a single sew line 50 is illustrated) located on the edges of both the top and bottom signboards 19 and 21; the outer sew lines are used for fabric material covering the lower and upper bill members 18 and 20, respectively. The brim portion of the fabric is the only material sewn onto the inside portions of sign boards 19 and 21 and will be sewn in over the outer edge portion of the information printed on signboards 19 and 21.

The primary display material comprises a high quality 4 color printing process applied directly onto the exposed surface of sign board 19 (display material can also be printed on the surface of signboard 21). The brim is sewn over the outer portions of the signboards 19 and 21.

FIG. 6 illustrates the present invention adapted for use with a visor 60.

During the cap fabrication process, portions of the cap material are then sewn over the signboards so they are not removable. The secondary display material Will be either (a) a sticker applied during production (stickers will have cutout holes which fit to scale with the pins and holes on the "tower and upper bill members", respectively), (b) bill that is completely covered in fabric inside and outside of the bill members, the artwork then being applied to the fabric; (c) an all white sticker or applied coating with clear glossy finish to resemble a white board so the end user can write their own custom message thereon; (d) a clear PVC sleeve sewn into the upper signboard with a single opening at top for a slide in custom template insert and; (e) both the upper and lower signboards are magnetized (or have a magnetic coating applied thereto) so that the end user can decorate the signboards with magnetized decorations.

The flip cap 10 of the present invention resembles normal caps, but is different in that the upper and lower bill members 18 and 20 are custom, molded/engineered to uphold cap functionality when flipped up and also snapped down. When cap 10 is flipped, the exposed surfaces of the signboards function as an advertising display (note that although the exposed surface of signboard 19 alone is the preferred method of displaying information, both signboards can display information at the same time). The upper bill member 20 is somewhat larger in size so bottom bill member 18 is less noticeable when the members are snapped together. In addition, holes 22 are configured to ensure less wear and tear and avoid breakage of the pin bottoms. The upper and lower bill members are preferably formed as two separately molded plastic pieces; the plastic signboards being fabricated at the time when the cap is assembled, the artwork, or information, being applied to the signboards prior to being sewn onto the cap as Will be described hereinafter.

The triangular ends 31 of signboard 19 are stationary as a result of being sewn into cap 10. The curved cutout allows signboard 19 to remain as one piece while still being able to maintain a flip up and down motion/movement without being separated from top bill member 20. The curved cut allows signboard 19 to seamlessly slide back and forth and function as a hinge.

The curved cutout portions 29 function as "legs/support structure" for signboard 19 allowing it to move vertically into place. These "legs" act as an important structural support when resting on the lower signboard 21. Because of the curved cutout design, signboard 19 can maintain an upright position in conjunction with a curved lower brim. Maintaining a vertical position is not possible with a straightened flat bill bottom; the cap resembles a flat bill look when it is in the snapped closed position. When upper member 20 is manually flipped up, the pressure created by the curved cuts 29 sliding forward automatically gives a slight bend to lower bill member 18 providing a support structure for signboard 19.

When flipped up, the curved design creates pressure on both corners of the lower bill member 18 creating a slight curvature therein. The pressure point creates a slight curvature on the bottom of signboard 21 where the two curved bottom upper bill member pieces 29 meet and touch the lower bill signboard 21 (plastic on plastic).

The force created by the pressure point enables signboard 19, and as a result, upper bill member 20, to remain locked in the upper flipped position. The downward force created from the pressure points (produced from manually flipping the bill up) causes a slightly curved lower bill which stabilizes the position of upper bill member 20.

The curved cutout seamlessly reverts back into flipped down position aligning with the triangular sewn in pieces 31; then both bills (upper and bottom) snap together back into place, the two separated bills thus becoming integral and again looking like a normal cap or visor bill. In essence, this sequence also aligns the male pins to the female holes, allowing both upper and lower members to seem as one bill when snapped into place.

Pins 61 and 63 ensure that the viewed signboard area is never positioned at more than a 90 degree optimal viewing angle even if the end user bends or curves the bottom bill to adjust for personal comfort.

The steps for producing the cap 10 of the present invention are as follows:

(a) The crown portion of the cap (or visor) is obtained from a manufacturer thereof;

(b) The signboard plastic members 18 and 20 are fabricated in separate molds with the custom features noted hereinabove;

(c) Fabric for the lower bill member 18 is sewn along the edges of signboard 21 to form a brim portion;

(d) Fabric for the upper bill member 20 is sewn along the edges of signboard 19 to form a brim portion;

(e) The formed lower and upper bill members are then sewn together; and (f) The joined lower and upper bill members are, in turn, sewn to the cap crown.

The present invention provides a flip-up cap (or visor) which has a unique mechanism for displaying information to an observer, the cap operating in two modes. In particular, the first mode is when the bill members are joined together and extends outward as would a conventional cap bill; and the second mode is when the bill members are spaced-apart by "being manually flipped up by the user or wearer" to display information.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A flip bill member comprising:

a crown portion to be worn on a head of a person;

a bill portion affixed to said crown portion and comprising upper and lower members; means for securing said upper and lower bill members together in a first position; and means for securing said lower and upper bill members in a spaced-apart from each other second position, said first and second position securing means comprises a plurality of holes formed in the upper bill member and a plurality of aligned pin members formed in said lower bill member, wherein said means for securing said lower and upper bill members in the spaced-apart second position further comprises a lower edge formed on said upper bill member, and said lower edge engages at least two of said pin members formed on said lower bill member when said lower and upper bill members are in the spaced-apart second position, thereby maintaining said lower and upper bill members in said spaced-apart second position.

* * * * *